US010631610B2

(12) United States Patent
Bonnemaire et al.

(10) Patent No.: US 10,631,610 B2
(45) Date of Patent: Apr. 28, 2020

(54) HAIRSTYLING APPLIANCE FOR CURLING HAIR WITH A STATIONARY FINGER FOR LOCKING AND RELEASING THE STRAND

(71) Applicant: SEB S.A., Ecully (FR)

(72) Inventors: Baptiste Bonnemaire, Lyons (FR); Régis Fereyre, Chavanay (FR)

(73) Assignee: SEB S.A., Ecully (FR)

( * ) Notice: Subject to any disclaimer, the term of this patent is extended or adjusted under 35 U.S.C. 154(b) by 0 days.

(21) Appl. No.: 15/750,080

(22) PCT Filed: Jul. 12, 2016

(86) PCT No.: PCT/FR2016/051798

§ 371 (c)(1),
(2) Date: Apr. 30, 2018

(87) PCT Pub. No.: WO2017/025669

PCT Pub. Date: Feb. 16, 2017

(65) Prior Publication Data

US 2018/0255898 A1 Sep. 13, 2018

(30) Foreign Application Priority Data

Aug. 7, 2015 (FR) ..... 1557632

(51) Int. Cl.
*A45D 2/10* (2006.01)
*A45D 1/16* (2006.01)
(Continued)

(52) U.S. Cl.
CPC ..... *A45D 2/10* (2013.01); *A45D 1/04* (2013.01); *A45D 1/16* (2013.01); *A45D 2/02* (2013.01); *A45D 2/08* (2013.01); *A45D 6/02* (2013.01)

(58) Field of Classification Search
CPC ... A45D 1/04; A45D 1/16; A45D 2/02; A45D 2/08; A45D 2/10; A45D 2/36; A45D 6/02
(Continued)

(56) References Cited

U.S. PATENT DOCUMENTS

D783,897 S * 4/2017 Kong ..... D28/35
2005/0268933 A1* 12/2005 Kimata ..... A45D 2/10 132/238

(Continued)

FOREIGN PATENT DOCUMENTS

DE 2816289 A1 10/1979
FR 2 373 986 A1 7/1978

(Continued)

OTHER PUBLICATIONS

International Search Report as issued in International Patent Application No. PCT/FR2016/051798, dated Sep. 8, 2016.

(Continued)

*Primary Examiner* — Yogesh P Patel
*Assistant Examiner* — Jennifer F Gill
(74) *Attorney, Agent, or Firm* — Pillsbury Winthrop Shaw Pittman LLP

(57) ABSTRACT

A hairstyling device for curling hair includes a housing including a rolling chamber, an insertion slot and an extraction opening arranged on a side end of the housing, and a mandrel which has one end fixed to the housing and a free end arranged near to the extraction opening, and which extends into the rolling chamber. A roller is arranged inside the rolling chamber and configured to roll the strand of hair around the mandrel, during rotation thereof. The device includes a stationary finger arranged at the contour of the extraction opening, the shape of which is configured with respect to the free end of the mandrel in order to block the rotation of the strand of hair around the mandrel without the (Continued)

risk of going beyond the finger during the rotation of the roller, and to promote the demoulding of the curled strand of hair along the mandrel.

19 Claims, 6 Drawing Sheets

(51) Int. Cl.
*A45D 2/08* (2006.01)
*A45D 2/02* (2006.01)
*A45D 1/04* (2006.01)
*A45D 6/02* (2006.01)

(58) Field of Classification Search
USPC ..... 132/238
See application file for complete search history.

(56) References Cited

U.S. PATENT DOCUMENTS

| | | | | |
|---|---|---|---|---|
| 2012/0325262 | A1* | 12/2012 | Sansole | A45D 2/02 132/210 |
| 2013/0068245 | A1* | 3/2013 | De Benedictis | A45D 2/02 132/237 |
| 2015/0114425 | A1* | 4/2015 | Park | A45D 1/04 132/229 |
| 2015/0128987 | A1* | 5/2015 | De Benedictis | A45D 2/02 132/238 |
| 2016/0255935 | A1* | 9/2016 | Li | A45D 6/02 |
| 2017/0127785 | A1* | 5/2017 | Chan | A45D 2/02 |
| 2017/0172273 | A1* | 6/2017 | Kock | A45D 2/02 |
| 2017/0202332 | A1* | 7/2017 | Keong | A45D 1/00 |

FOREIGN PATENT DOCUMENTS

| | | | |
|---|---|---|---|
| JP | S61-10102 | U | 1/1986 |
| WO | WO 2009/077747 | A2 | 6/2009 |
| WO | WO 2012/080751 | A2 | 6/2012 |
| WO | WO 2013/186547 | A1 | 12/2013 |

OTHER PUBLICATIONS

International Preliminary Report on Patentability and the Written Opinion of the International Searching Authority as issued in International Patent Application No. PCT/FR2016/051798, dated Feb. 13, 2018.

* cited by examiner

HAIRSTYLING APPLIANCE FOR CURLING HAIR WITH A STATIONARY FINGER FOR LOCKING AND RELEASING THE STRAND

CROSS-REFERENCE TO RELATED APPLICATIONS

This application is the U.S. National Stage of PCT/FR2016/051798, filed Jul. 12, 2016, which in turn claims priority to French patent application number 1557632 filed Aug. 7, 2015. The content of these applications are incorporated herein by reference in their entireties.

TECHNICAL FIELD

This invention relates to the field of hair styling appliances for curling strands of hair, in particular those equipped with an automated strand winding device to curl the strand.

STATE OF THE ART

Such hair styling appliances for curling strands of hair, with an automated strand winding device to curl the strand, are already known to those skilled in the art. For example, patent applications published under the numbers FR2373986A1, DE2816289A1, WO2009077747A2, WO2012080751A2, WO2013186547A1 describe such hair styling appliances. According to this type of design, the hair styling appliance comprises a housing which has a winding chamber having an opening for inserting the hair strand, a mandrel arranged in this winding chamber and a winder configured to wind the hair strand around the mandrel.

In the patent application FR2373986A1, the winder is shaped like a spiral with teeth such that when the appliance is turned on, the strand of hair can be grasped and wound around the heating mandrel.

In the patent application DE2816289A1, the winder is in the form of a cylinder coaxially arranged around a portion of the mandrel in a winding chamber of the housing. The mandrel has a conical head which extends outside the winder and the winding chamber of the housing. The winder has a notch with a hook that permits winding the strand around the winder and around the conical head of the mandrel, while moving the hair styling appliance against the scalp.

The aforementioned hair curling appliances, described in FR2373986A1 and DE2816289A, are complicated to use and are not ergonomic. In addition, they do not permit effective hair curling, because the wound hair is not kept close to the mandrel for proper curl formation.

In the patent application WO2009077747A2, the housing of the hair styling appliance has a slot arranged along the length of a winding chamber, through which the hair strand penetrates in order to be wound around the mandrel. Lateral guide blades are arranged in a V shape and longitudinally outside of the slot in order to receive a strand. The winder is in the form of a disk arranged around the mandrel. The disk is larger than the housing, such that it passes through the slot and the guide blades. The disk has a radial notch that leads to its peripheral contour and forms a hook, such that said notch can be positioned through the slot and between the guide blades, to facilitate positioning the hair strand in the notch in order to grasp the strand. Once the strand is in position in the notch, the strand is wound around the mandrel in the winding chamber, from the scalp to the end of the strand. The design of this winder requires the grasped strand to be wound around both sides of the disk, which generates tension on the hair throughout winding, and thus risks hair damage. In addition, the strand may easily become stuck in the winding chamber of the housing, because of this winding on both sides of the disk. In addition, this design is very bulky.

In the patent application WO2012080751A2, the hair curling appliance is in the form of a clamp formed of two arms. The housing is arranged at the end of one of the two arms and has an insertion slot that extends longitudinally on the housing in the direction of a winding chamber with which said slot communicates. The housing has external guide elements that are arranged outside the slot in the shape of a V and make it possible to guide the strand of hair in order to insert it through the slot in the winding chamber. Comparable to the hair styling appliance described previously in the document WO2009077747A2, the winder is in the form of a disk shaped like a hook that passes through the slot in order to be positioned between the guide elements. The second arm has in its extremity a second housing with a receiving area for the guide elements and a bearing surface, to permit the bearing surface to push the hair strand toward the slot while being guided by the guide elements, thus permitting the winder to grasp the strand in order for it to be wound around the mandrel. This design is also very bulky. In addition, its design is complex, which complicates its production and increases its manufacturing cost. According to this design, the housing has at one of its ends an extraction opening to which the winding chamber leads, the free end of the mandrel being arranged close to this extraction opening. A retractable finger is arranged at the contour of the extraction opening. In extended position, this retractable finger permits preventing the rotation of the strand during its winding around the mandrel. In retracted position, the mandrel is disengaged, which permits releasing the curled strand without risk of undoing or loosening it. Such a retractable finger necessitates the implementation of a complex and costly mechanism.

In the patent application WO2013186547A1, as for the patent application WO2012080751A2, the housing defines a winding chamber in which extends a mandrel with one end fixed to the housing and a free end adjacent to an extraction opening to which the winding chamber leads. The winder is also in the form of a disk with a notch forming a hook that permits grasping the strand to wind it around the mandrel. In a first implementation, the housing has a large insertion opening to permit positioning the strand in the winding chamber. In a second variant, the housing has an insertion slot that extends longitudinally and communicates with the winding chamber, above the mandrel, V-shaped guide elements being arranged outside the slot in order to facilitate positioning the strand facing the slot. According to these different variants, the hair curling appliance comprises an insertion device configured to push the strand inside the insertion opening or the insertion slot and position it in the notch on the disk. This design is complex and implements a large number of parts, making its production difficult and increasing its manufacturing cost. In addition, this design also makes it more bulky.

SUMMARY OF THE INVENTION

The main objective of this invention is to implement a hair styling appliance that permits locking the strand during its winding around the mandrel and that facilitates the release of the curled strand, presenting a simple design, easy to implement and inexpensive, in particular in comparison to the retractable finger used on the hair styling appliance described in the document WO2012080751A2.

Another objective is to prevent the strand from becoming stuck or entangled inside the winding housing, and to make regular curls without damaging the hair.

Another objective is to be able to easily grasp the strand in order to wind it, while remedying the aforementioned drawbacks of prior hair curling appliances.

Another objective is to propose a hair curling appliance that permits effective treatment of the hair, while being easy and practical to use.

Another objective of this invention is to curl the strand of hair substantially on its entire length without reducing the effectiveness of the hair styling appliance and without risk of burning the scalp.

For these purposes, the invention concerns a hair styling appliance for curling a strand of hair, comprising a housing which comprises a winding chamber having a shape of revolution along a second axis X2. The housing also has an insertion slot which extends along the length of the housing in the direction of the second axis X2 and which leads to the winding chamber. The housing also has an extraction opening, arranged at a lateral end of the housing, to which the winding chamber leads. One could envision replacing the insertion slot with an insertion opening, with larger dimensions and a shape different from that of a slot, without departing from the context of the invention. However, in a preferred embodiment which is described below, the insertion slot is favored.

According to the invention, the hair styling appliance also comprises a mandrel with one end fixed to the housing and a free end arranged close to the extraction opening, and which extends in the winding chamber along a third axis X3 defined in a plane P passing through the second axis X2 and through the slot.

According to the invention, the hair styling appliance also comprises a winder arranged in the winding chamber and rotatably mounted in at least one direction along the third axis X3. This winder is configured to wind the strand around the mandrel during its rotation, in order to make the curl.

Remarkably, according to the invention, the hair styling appliance comprises a stationary finger arranged at the contour of the extraction opening, or in direct proximity to this contour, in front of the free end of the mandrel. The shape of the stationary finger is configured with respect to the free end of the mandrel to prevent the rotation of the strand around the mandrel without risk of bypassing the finger during the rotation of the winder, and to help release the curled strand along the mandrel at the end of the curling operation. The presence of such a stationary finger advantageously permits simplifying the design of the hair styling appliance, unlike the existing systems from the prior art, which are much more complex, such as, for example, the appliance described in the patent application WO2012080751A2.

In an embodiment of the invention, the stationary finger is perpendicular to the third axis X3 and parallel to the plane P. In addition, the stationary finger has at least one lateral locking face configured so that the straight line dl, which passes through the base of the lateral locking face and perpendicularly cuts the third axis X3, forms with said lateral locking face an angle β of between 0 and 35 degrees, preferably 25 degrees. This advantageously permits sliding the hair strand toward the base of the stationary finger rather than toward its end, which prevents bypassing the finger during winding of the strand. Preferably, the winder turns in both directions of rotation around the mandrel. In addition, the stationary finger has two lateral locking faces arranged symmetrically with respect to the plane P.

In an embodiment of the invention, the stationary finger is perpendicular to the third axis X3 and parallel to the plane P. In addition, the finger is configured to extend from the peripheral contour of the free end of the mandrel in the direction of the third axis X3, at a height h1 between 6 mm and 18 mm, preferably 12 mm. This also helps prevent the strand from bypassing the stationary finger during its winding, without harming the release of the curled strand.

In an embodiment of the invention, the stationary finger is perpendicular to the third axis X3 and parallel to the plane P. In addition, the finger is spaced apart from the free end of the mandrel by a distance e1 of between 1 mm and 5 mm, preferably 3 mm. This also permits a good compromise between locking the strand during its winding around the mandrel, without risk of bypassing the stationary finger, and releasing the curled strand appropriately without risk of loosening it.

Preferably, the mandrel has a diameter D of between 20 mm and 25 mm, preferably 22 mm, for a stationary finger presenting the aforementioned characteristics.

Preferably, the stationary finger has an inner face arranged facing the free end of the mandrel. This inner face has a curved shape configured to support the release of the strand of curled hair through the extraction opening. The inner face has an end adjacent to the contour of the extraction opening, which extends in the form of a projection that is more or less pronounced, to prevent the curled strand from passing below the stationary finger during the release and remaining locked.

Preferably, according to this embodiment of the hair styling appliance, removable fixing means are arranged between the stationary finger and the contour of the extraction opening. This advantageously permits replacing the finger with another presenting slight shape modifications, for example, in order to better adapt the hair styling appliance to the type of hair to be curled.

In an embodiment of the hair styling appliance according to the invention, the winder is hollow and has a surface of revolution along the third axis X3. The winder is arranged with a first spacing around the mandrel in the winding chamber, coaxial with the mandrel along the third axis X3. The winder is rotatably mounted in at least one direction along the third axis X3, preferably according to both directions of rotation. The winder has on its surface of revolution catching means which are configured to catch the strand in the winder's initial position, and then to rotate the strand during the rotation of the winder. In addition, the winder is configured to successively grasp or catch the proximal end of the strand, concomitantly wind the strand around the mandrel and the winder, and then completely wind the strand around the mandrel, during its rotation. This design of the hair styling appliance according to the invention advantageously permits dividing the winding chamber into two concentric chambers: one inner chamber defined by the first spacing between the mandrel and the winder, and one outer chamber defined by the spacing outside the winder, inside the winding chamber. This permits winding the hair strand around the mandrel and the winder at the same time. The winder, which surrounds the mandrel along its length, has a larger winding diameter than the mandrel, to permit winding hair around the winder with less tension. There is thus little risk of hair damage. In addition, the longitudinal shape of the mandrel and of the winder permits winding the hair strand on relatively large surface areas, to prevent the hair from becoming stuck.

In an embodiment of the hair styling appliance according to the invention, the curling appliance comprises a grip handle which extends longitudinally along a first axis X1 and which is attached to the housing. The grip handle may be in various aesthetic and ergonomic forms in order to permit a suitable grip. This slot is positioned on the housing on the side opposite the position of the grip handle. The plane (P) is defined by the first axis X1 and the second axis X2. In addition, the third axis X3 is inclined with respect to the first axis X1 according to an angle $\alpha$ such that the free end of the mandrel is farther from the grip handle than the fixed end of the mandrel. This design of the hair styling appliance according to the invention advantageously permits inserting the strand in the insertion slot, while positioning it at an angle to the mandrel and the winder, and then inserting the strand in the catching means on the winder's surface of revolution, without the need to tilt the strand with respect to the slot. This considerably facilitates the manipulation of the appliance, with the user inserting the strand in the slot while holding the grip handle naturally, without any complication related to its positioning, and then holding the extraction opening against the scalp such that the end of the hair strand, situated in proximity to the roots, is positioned in the catching means.

In an embodiment of the hair styling appliance according to the invention, the angle $\alpha$ is between 50 and 80 degrees, preferably 70 degrees.

In an embodiment of the hair styling appliance according to the invention, the second axis X2 is perpendicular to the first axis X1. According to this configuration, the housing is perpendicular to the grip handle, the mandrel and the winder being inclined in the winding chamber. In an embodiment variant of the hair styling appliance according to the invention, the second axis X2 and the third axis X3 are parallel to each other, preferably coincident. This configuration permits keeping the mandrel and the winder in the axis of the housing's winding chamber, and inclining the housing with respect to the handle, while preserving the advantage of facilitating the positioning of the hair strand in the slot and in the winder's catching means. In addition, one could envision numerous variants without departing from the context of the invention. In this regard, in embodiment variants of the hair styling appliance according to the invention, the second axis X2 is inclined with respect to the first axis X1, on the same side as the third axis X3, by an angle $\varphi$ between the angle of inclination $\alpha$ of the third axis X3 and 90 degrees ($\alpha<\varphi<90°$)

In an embodiment of the hair styling appliance according to the invention, the winder has a free edge arranged on the free end side of the mandrel. In addition, the winder has a notch, constituting the catching means, which extends on the surface of revolution and leads to the free edge, the notch being configured to allow the strand to penetrate in the first spacing between the mandrel and the winder, in the initial position of the winder. According to this embodiment, gripping means are formed on at least one of the two ends of the notch, intersecting with the free edge, preferably on both ends. These gripping means are preferably in the form of hooks. A single hook can be envisioned when the winder rotates in only one direction, Preferably, the winder rotates in both directions along the third axis X3, and two hooks are arranged facing each other at the two aforementioned ends of the notch. Preferably, according to this embodiment, the notch has the shape of a trapezoid with its small base adjacent to the free edge. However, one could envision variants in the shape of the notch, for example a circular or oval shape.

In an embodiment of the hair styling appliance according to the invention, the winder has a cylindrical shape along the third axis X3. In a preferred embodiment variant, the winder has a conical shape along the third axis X3, the conical shape presenting an expansion in the direction of the free end of the mandrel.

In an embodiment of the hair styling appliance according to the invention, the insertion slot has two walls which extend longitudinally in the direction of the second axis X2 and which form between them a V configured to help the strand penetrate the winding chamber. Thus, unlike the prior art, which provides for additional elements forming a V arranged outside the slot, the invention provides for directly integrating the V shape in the thickness of the housing, which considerably reduces the overall dimensions of the hair styling appliance.

Preferably, according to this embodiment, the slot has a longitudinal end portion, opposite the position of the extraction opening, in which the two walls are connected to each other and form an entire V in a single piece, with the bottom of the V being rounded and configured to guide the strand and let it slip during its winding around the mandrel and the winder. This longitudinal portion is arranged upstream from the mandrel and the winder, on the housing. This design also helps to reduce any tension on the strand during its winding around the mandrel and the winder. According to a variant, the slot has a longitudinal end portion, opposite the position of the extraction opening, in which the two walls are connected to each other and form a curved bottom, more or less in the shape of a spoon, configured to guide the strand and let it slip during its winding around the mandrel and the winder. This longitudinal portion is arranged upstream from the mandrel and the winder, on the housing.

In an embodiment of the hair styling appliance according to the invention, the insertion slot has two walls which extend longitudinally in the direction of the second axis X2 and which each have ribs arranged transversally with respect to a second axis X2. These ribs are distributed along each wall and are configured to help the strand penetrate the winding chamber. These ribs have the advantage of implementing linear contacts between the slot and the hair strand during the insertion of the latter, in order to reduce friction and limit the risk that the strand will become stuck in the slot. Preferably, according to this embodiment, the ribs are each in the form of a portion of a disk, which permits gradually reducing the passage cross section of the slot, like a V arranged between the two walls, and thus permits guiding the strand during its insertion in the slot. One could envision shape variants for these ribs, while also helping to reduce the passage cross section of the slot, such as a triangular shape, for example. Preferably, according to this embodiment, the ribs on each wall are of variable dimensions, with a variable distribution on each wall.

In an embodiment of the hair styling appliance according to the invention, the insertion slot has two walls which extend longitudinally in the direction of the second axis X2 and which each present waves spread along the walls. These waves are configured to help the strand penetrate the winding chamber. These waves have the advantage of reducing contacts between the slot and the hair strand during the insertion of the latter, which reduces friction and limits the risk that the strand will become stuck in the slot.

In another embodiment, the slot combines the characteristics of at least two of the three aforementioned embodiments, namely in particular the presence of two walls forming a V and/or the presence of waves on the two walls and/or the presence of ribs on these two walls. These various characteristics each constitute guide means arranged in the slot and configured to help the strand penetrate the winding chamber. Of course, other variants of guide means could be envisioned without departing from the context of the invention.

According to the hair styling appliance according to the invention, the latter comprises heating means configured to heat the strand of hair inside the winding chamber. Preferably, the heating means
are arranged in the mandrel. However, one could envision heating means arranged in the winding chamber in order to heat the strand during its concomitant winding around the mandrel and the winder.

In an embodiment of the hair styling appliance according to the invention, the housing additionally has an inner cage arranged in the winding chamber around the winder, with a second spacing with respect to the winder. The inner cage is configured to prolong the guiding of the hair strand inside the winding chamber in the direction of the winder, after it passes through the slot. This also permits confining the strand inside the housing around the winder, without risk of dispersion in the winding chamber.

According to the hair styling appliance according to the invention, the latter comprises means for gripping the housing, consisting of a handle which extends in the plane P in the direction opposite the position of the slot. This permits a more ergonomic hair styling appliance, which can be easily manipulated during insertion of the strand of hair in the slot. However, one could envision other configurations of gripping means without departing from the context of the invention.

BRIEF DESCRIPTION OF THE FIGURES

The following description illuminates the object of the invention, with the support of figures, in which.

DETAILED DESCRIPTION

In the rest of the description, the same references are used to describe similar characteristics according to the various embodiments.

In the rest of the description, the term "appliance" will be used to designate the hair curling appliance according to the invention, unless otherwise indicated.

Figure 1:
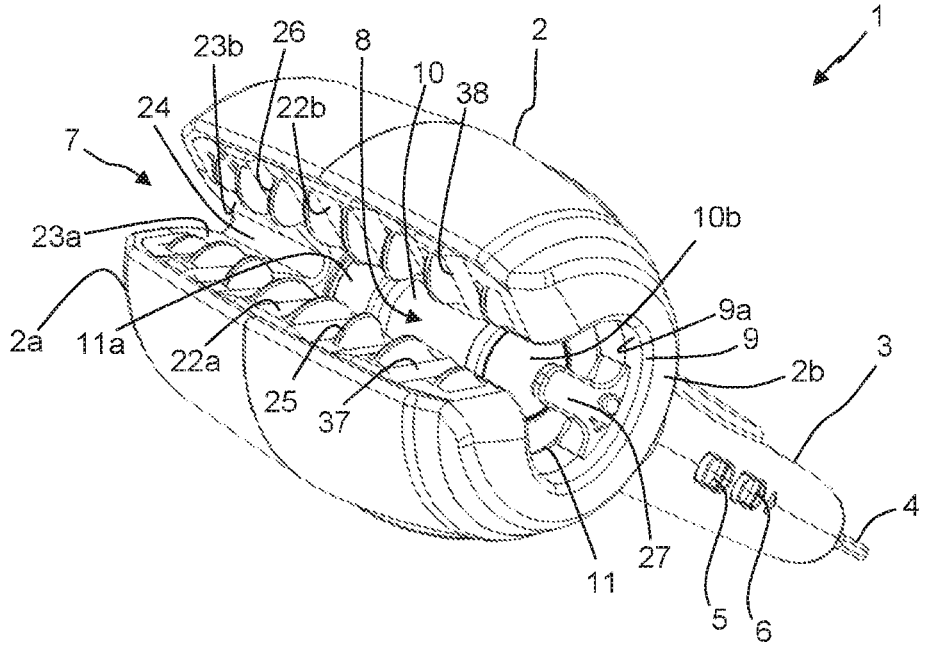
FIG. 1 illustrates a three-dimensional view of a hair curling appliance according to a first embodiment.

In FIG. 1, the appliance 1 comprises a housing 2 and a grip handle 3. The appliance 1 is connected electrically to a power source by an electric cable 4 and comprises control buttons 5, 6 permitting actuating the heating means and the means for rotating the winder, described in more detail below.

Figure 2:
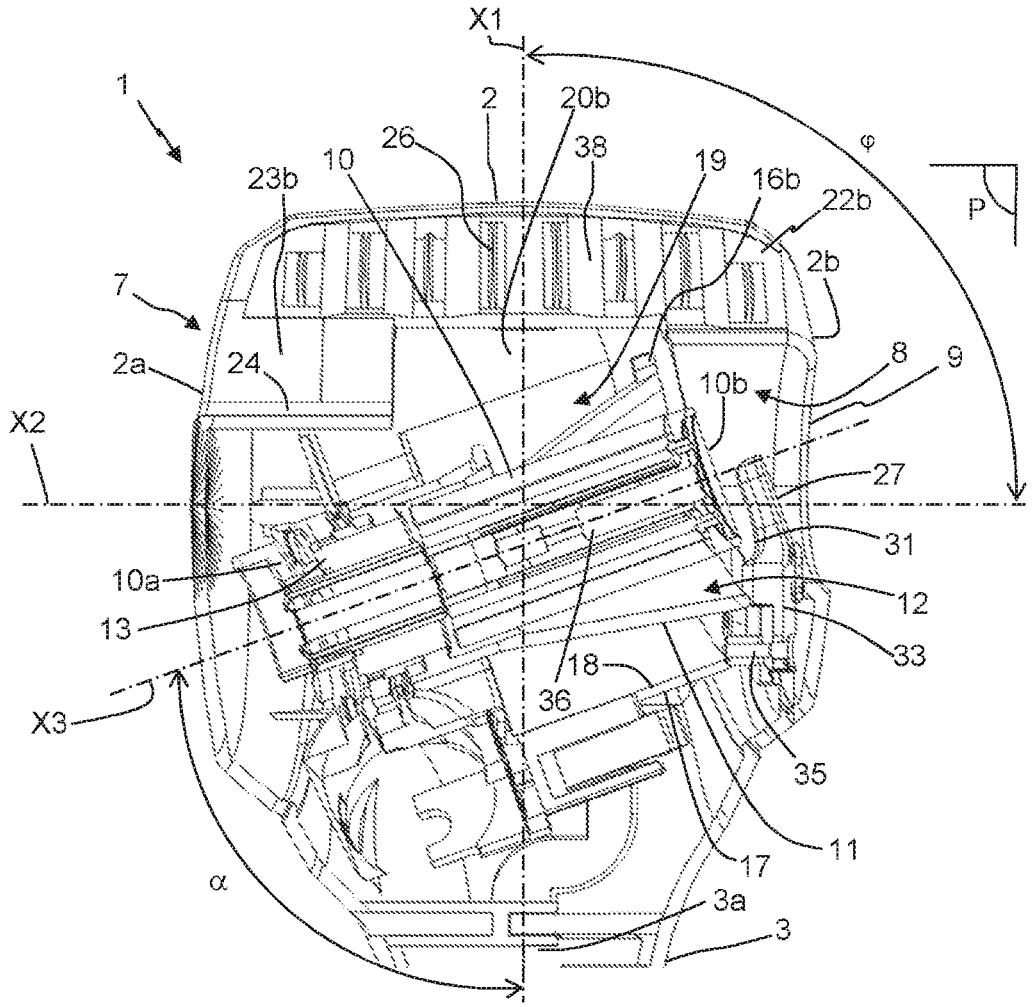
FIG. 2 illustrates a sectional view of the part of the hair curling appliance corresponding to the housing, according to this first embodiment.
Figure 3:
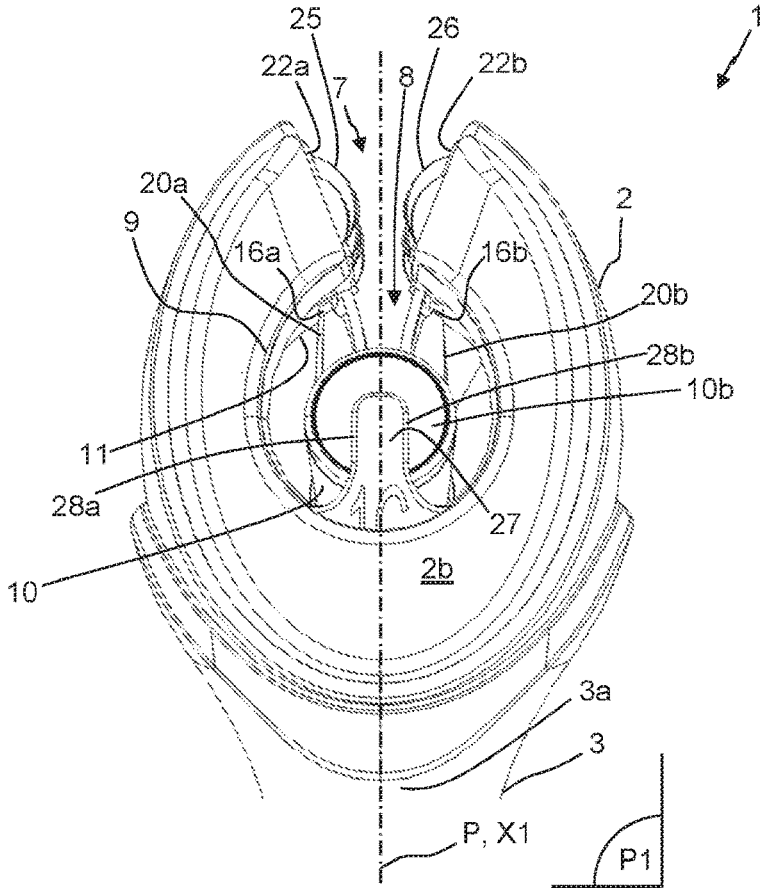
FIGS. 3 and 4 illustrate the housing of the hair curling appliance in front and rear views, according to this first embodiment.
Figure 4:
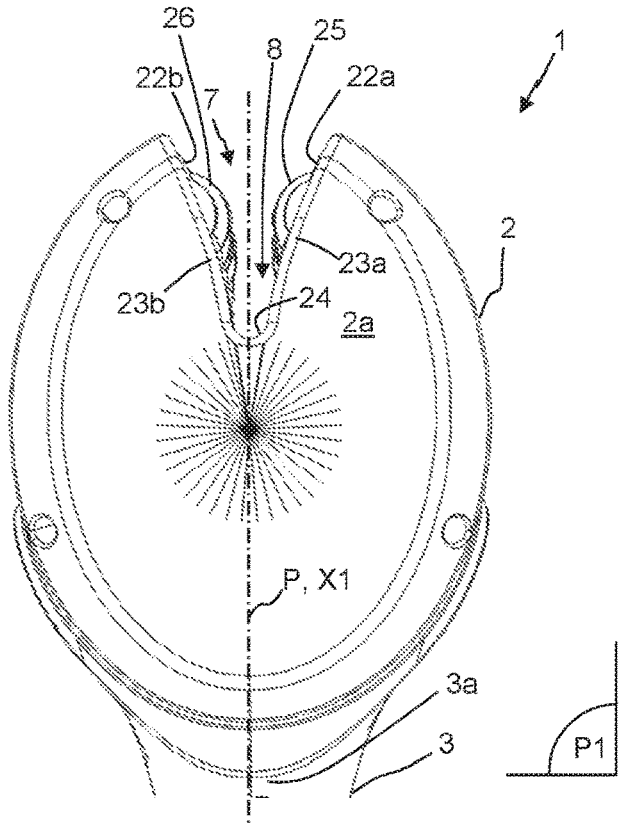

As illustrated in FIGS. 2 to 4, the grip handle 3 extends longitudinally along a first axis X1.

As illustrated in FIGS. 1 to 4, the housing 2 has a slot 7 permitting the hair strand (not illustrated) to be inserted in a winding chamber 8 defined inside the housing 2, in which the curling of the strand takes place. The housing 2 also has on its front lateral face 2*b* an extraction opening 9 through which the strand is released or removed after it is curled. The winding chamber 8 has a more or less cylindrical shape of revolution which is defined along a second axis X2 corresponding to the longitudinal direction of the housing 2. The first axis X1 and the second axis X2 are perpendicular to each other and define a plane P, illustrated in FIGS. 1 to 3, forming a plane of symmetry of the housing 2, and of the grip handle 3. The slot 7 is arranged in this plane P on the housing 2, on the side opposite the position of the grip handle 3.

As illustrated in FIGS. 1 to 3 and 6, the appliance 1 comprises a mandrel 10 which has a fixed end 10*a* assembled to the housing 2. The mandrel 10 also has a free end 10*b* which is positioned in proximity to the extraction opening 9 in the winding chamber 8. The mandrel 10 extends longitudinally inside the winding chamber 8 along a third axis X3 which defines with the first axis X1 an angle of inclination $\alpha$ of between 50° and 80°. Preferably, this angle of inclination $\alpha$ is 70°. This inclination of the mandrel 10 advantageously permits positioning its free end 10*b* farther from the end 3*a* of the grip handle 3 than its fixed end 10*a*, which will facilitate the positioning of the strand in order to wind it, as is explained below. The third axis X3 is defined in the plane P illustrated in FIGS. 1 to 3. The slot 7 is arranged symmetrically with respect to this plane P, as illustrated in particular by FIGS. 3 and 4.

As illustrated in FIGS. 1 to 3, 5 and 6, the appliance 1 comprises a winder 11 which is hollow and has a shape of revolution along the third axis X3. The winder 11 is positioned coaxial with the mandrel 10, along this third axis X3, and defines with the latter a first spacing 12 illustrated in particular in FIGS. 2 and 6. As illustrated in particular in FIG. 5, the winder 11 has at its first longitudinal end 11*a* splines 13 arranged to permit the winder 11 to be fastened to a gearwheel (not illustrated) which meshes with a worm screw (not illustrated) rotated by a motor (not illustrated), which permits rotating the winder 11 along the third axis X3. Preferably, the direction of rotation of the motor is reversible, which permits reversing the direction of rotation of the winder 11. The motor, the gearwheel and the worm screw are not illustrated in order to make the figures easier to read, the latter furthermore being within the grasp of those skilled in the art. Other gear means may be envisioned between the motor and the winder 11, also within the grasp of those skilled in the art.

Figure 5:
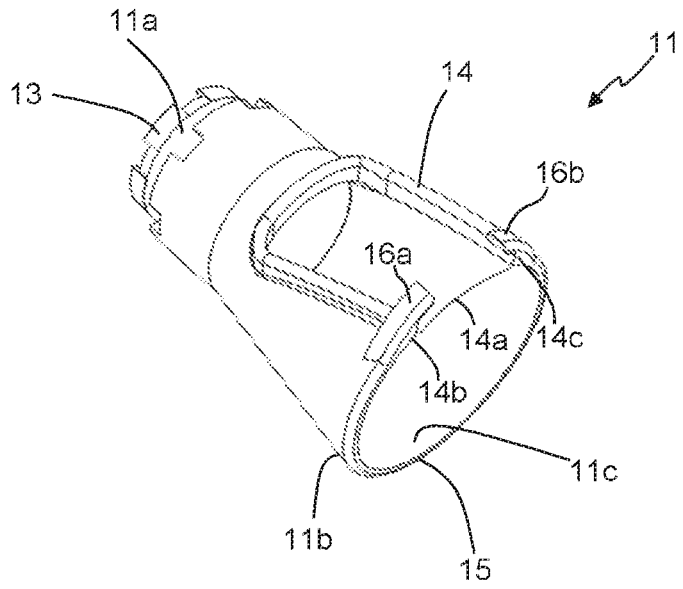
FIG. 5 illustrates a three-dimensional view of a preferential embodiment of the winder.
Figure 6:
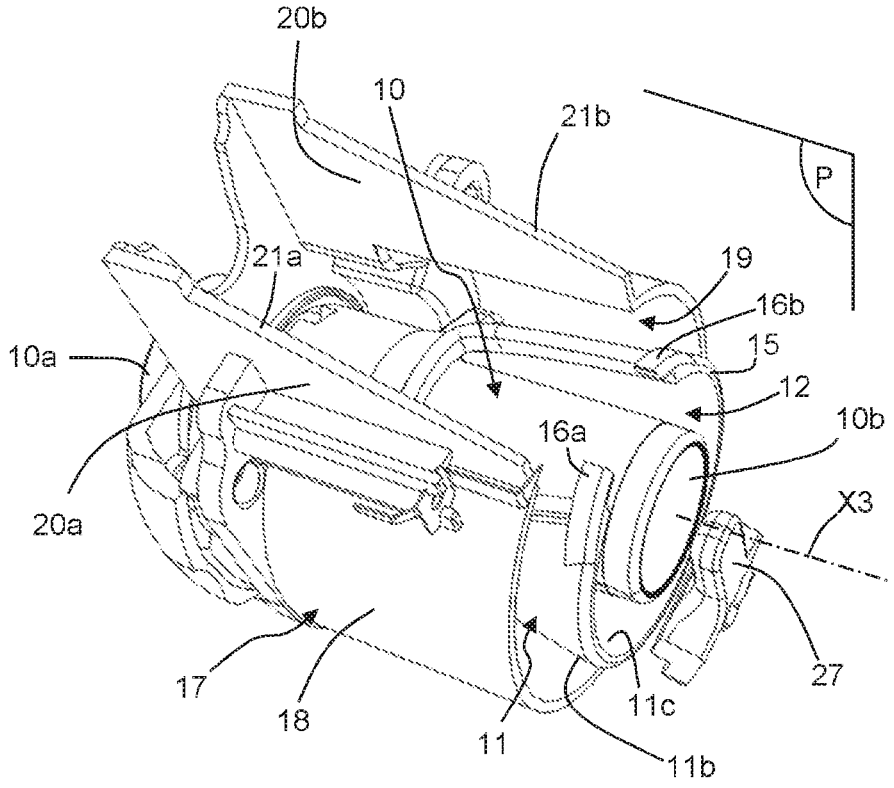
FIG. 6 illustrates a three-dimensional view of the mandrel, the winder, the inner cage and the stationary finger in their assembled position inside the housing of the hair curling appliance.

As illustrated in particular with regard to FIGS. 2, 5 and 6, the winder 11 has a conical shape which extends in expansion along the third axis X3 in the direction of the free end 10*b* of the mandrel 10. The winder 11 has a notch 14, or cut, which extends on its surface of revolution and which leads to the free edge 15 on the second longitudinal end 11*b* of the winder 11. This notch 14 preferably has the shape of a trapezoid with its small base 14*a*, illustrated in dashed lines on FIG. 5, arranged at the free edge 15. However, other shapes for this notch 14 could be envisioned, for example a more or less cylindrical or oval shape. Likewise, the winder 11 could have a cylindrical surface of revolution. There will be a preference for a conical surface of revolution and the trapezoidal notch 14, which favor better winding of the strand along the winder 11. At the two ends 14*b*, 14*c* of the notch 14 intersecting with the free edge 15, two hooks 16*a*, 16*b* are arranged facing each other in line with the free edge 15, preferably with a slight offset to the outside with respect to the latter, as illustrated in FIG. 5. These two hooks 16*a*, 16*b* are spaced apart by a width corresponding more or less to that of the slot 7. In the initial position of the winder 11, at the beginning of the curling operation, the notch 14 and the two hooks 16*a*, 16*b* are arranged symmetrically with respect to the plane P, in line with the slot 7, as illustrated in FIG. 3, which permits inserting in this slot 14 the part of the hair strand situated in proximity to the scalp. Rotating the winder 11 then permits one of the two hooks 16*a*, 16*b*, according to the direction of rotation of the motor, to grasp the strand to begin winding it, which is described below. The rotation of the winder 11 in both directions around the third axis X3 permits making curls in both directions. However, one could anticipate a single direction of curl, in which case a single hook would be sufficient and the configuration of the notch 14 could be adapted. In the initial position, the angle of inclination α between the two axes X1 and X3, as stated above, advantageously permits positioning the notch 14 and the two hooks 16*a*, 16*b*, situated close to the free edge 10*b* of the mandrel 10 and in proximity to the slot 7 with an inclination with respect to the grip handle 3. This facilitates the insertion of the strand in the slot 7 by positioning it at an angle to the winder 11 for its insertion in the notch 14, while manipulating the grip handle 3 normally.

As illustrated in FIGS. 2 and 6, the appliance 1 comprises an inner cage 17 which is arranged in the winding chamber 12. Preferably, this inner cage 17 has a part 18 having a cylindrical shape of revolution along the third axis X3, coaxially arranged around the winder 11 along the third axis X3, with a second spacing 19 with respect to the winder 11. Thus the first spacing 12 between the mandrel 10 and the winder 11 defines an inner chamber and the second spacing 19 between the winder 11 and the part 18 of the inner cage 17 defines an outer chamber. The inner cage 17 further has two flanges 20*a*, 20*b* which extend in the winding chamber 8 parallel to the plane P and symmetrically with respect to this plane P, the respective upper edges 21*a*, 21*b* of these flanges 20*a*, 20*b* being configured to be positioned adjacent to the slot 7, which permits better guiding of the strand up to the winder 11 by confining the strand in the winding chamber 12 inside the second spacing 19 of the inner cage 17. This inner cage 17 also permits arranging the components of the appliance 1 in the housing 2 while avoiding any risk of contact between the strand and these components during the positioning of the strand in the winding chamber 8.

As illustrated in FIGS. 1 to 4, the slot 7 has two walls 22*a*, 22*b*, which are arranged facing each other, symmetrically with respect to the plane P, in the thickness of the housing 2. These walls 22*a*, 22*b* extend on the entire length of the housing 2 and form, in a section plane P1 perpendicular to the plane P, a V which helps with insertion of the strand in the slot 7. In their parts 23*a*, 23*b* situated on the side of the lateral face 2*a* of the housing 2 opposite the lateral face 2*b* of the housing 2 which has the extraction opening 9 and which comes into contact with the scalp during curling, the walls 22*a*, 22*b* are connected and form together an entire V in a single piece with a bottom 24 which is rounded and permits guiding the hair strand by letting it slip along the length of the housing 2, that is, in the direction of the second axis X2. These parts 23*a*, 23*b* are situated upstream from the mandrel 10 and the winder 11, according to the direction of travel of the strand while it is being wound. Preferably, these two walls 22*a*, 22*b* consist of a single piece independent from the housing 2, which permits making the slot 7 in a different color from that of the housing 2, so that it can be seen more easily during insertion of the hair strand. In addition, removable fixing means are arranged between the housing 2 and the walls 22*a*, 22*b* to permit them to be removed, for example in order to replace them with others with a different V angle or other characteristics of guiding the strand in the slot 7. These removable fixing means (not illustrated) may consist of screwing or snap-fitting the walls 22*a*, 22*b* on the housing 2, for example.

As illustrated in FIGS. 1 to 4, cross ribs 25, 26 are implemented respectively on the two walls 22*a*, 22*b*, these cross ribs 25, 26 each having the form of a portion of a disk. On FIGS. 1 to 4, it is observed that the wall 22*b* has eight cross ribs 26, in the form of a portion of a disk, which have different dimensions and are spaced differently. The same is true for the cross ribs 25 on the other wall 22*a*. These cross ribs 25, 26 permit having linear contacts with the hair strand, which reduces friction of the strand in the slot 7 during its insertion. The fact that these cross ribs 25, 26 have the form of a portion of a disk also permits having a flared shape more or less forming a V between the cross ribs 25, 26 arranged facing each other on the two walls 22*a*, 22*b* of the slot 7, which also favors the positioning of the strand in the slot 7. This disk shape of the cross ribs 25, 26 could be replaced with a triangular shape, which would also permit forming a V between the cross ribs 25, 26 arranged facing each other on the walls 22*a*, 22*b*.

Figure 7:
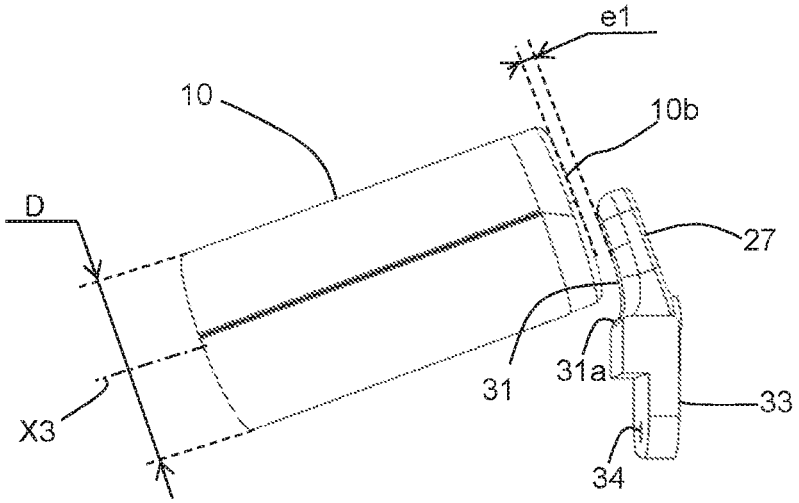
FIGS. 7 and 8 illustrate, respectively, a side view and a front view of the mandrel and of the stationary finger in their assembled position inside the housing of the hair curling appliance.
Figure 8:
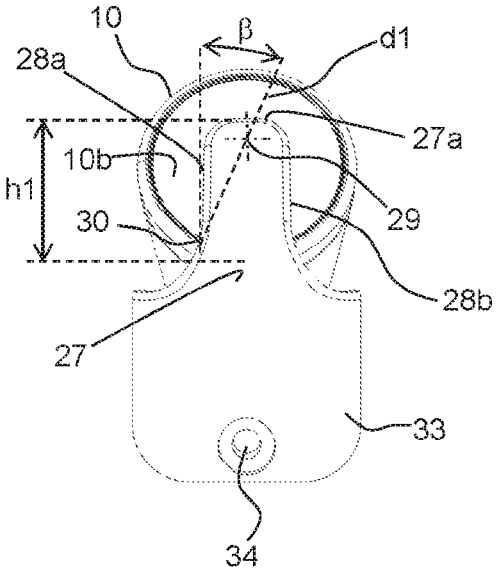

As illustrated in FIGS. 1 to 3, 6 and 7, the appliance 1 comprises a stationary finger 27, or fixed finger, consisting of a rigid part which is attached at the contour 9*a* of the extraction opening 9. This stationary finger 27 has several functions. First, the stationary finger 27 permits preventing the strand from rotating during its winding in order to prevent the strand from turning around the mandrel 10. In addition, this stationary finger 27 must ensure release of the curled strand without damaging it. The stationary finger 27 is perpendicular to the mandrel 10, that is, perpendicular to the third axis X3, as illustrated in particular in FIGS. 2 and 7. The inclination of the stationary finger 27 thus depends on the inclination of the angle α. During the winding of the strand around the mandrel 10, the strand is locked by one of the two lateral locking faces 28*a*, 28*b* of the stationary finger 27, according to the direction of rotation of the winder 11. These two lateral locking faces 28*a*, 28*b* are arranged symmetrically with respect to the plane P. So that the hair is not able to bypass the stationary finger 27 during winding, the angle β formed between the lateral locking face 28*a* and a straight line dl going from the center 29 of the mandrel 10 to the base 30 of the lateral locking face 28*a*, as illustrated in FIG. 8, must ideally form an angle of between 0° and 35°. Preferably this angle β is 25°. The same is true for the second lateral locking face 28*b* which is arranged symmetrically with respect to the first lateral locking face 28*a*, according to the plane P. In this manner, the hair strand tends more to slide toward the base 30 of the stationary finger 27 rather than toward its end 27*a*.

Also to better ensure that the hair strand does not tend to bypass the stationary finger and turn around the mandrel 10 during winding, the stationary finger 27 must sufficiently cover the free end 10*b* of the mandrel 10, and its distance from the mandrel 10 must be
as small as possible. In order to permit this sufficient coverage, the stationary finger 27 extends from the cylindrical contour of the mandrel 10 on a height h1 of between 6 mm and 18 mm, preferably a height h1 equal to 12 mm. A higher height h1 would risk penalizing the release, and a lower height h1 would risk not sufficiently locking the hair. Concerning the distance to the mandrel 10, the stationary finger 27 is spaced from the free end 10*b* of the mandrel 10 by a distance e1 of between 1 mm and 5 mm, this distance e1 preferably being equal to 3 mm. This distance e1 depends on the height h1 used for the stationary finger 27. Preferably a ratio r of four between the height h1 and the distance e1 is provided for (r=h1/e1=4), this ratio r being between two and five (2<r<5).

For this aforementioned configuration of the stationary finger 27 with respect to the mandrel 10, the mandrel 10 has a diameter D of between 20 mm and 25 mm, preferably 22 mm.

Figure 9:
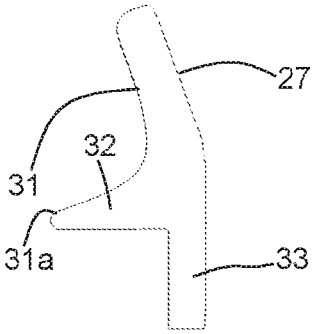
FIG. 9 illustrates an embodiment variant of the stationary finger.

The stationary finger 27 has an inner face 31 arranged facing the free end 10*b* of the mandrel 10. The inner face 31 is curved or concave, as illustrated in particular in FIGS. 3 and 8, which permits supporting the expulsion of the strand of curled hair during its release. The lower end 31*a* of this inner face 31 must be as far as possible below the mandrel 10, so that during release, the hair does not pass below this stationary finger 27, which would lock it. This lower end 31*a* must not form too pronounced a point, but must have a rounded form in order to appropriately direct the curled strand on the inner face 31, and not below the stationary finger 27. In the embodiment variant illustrated in FIG. 9, the stationary finger 27 has a curved inner face 31 with its lower end 31*a* which extends in the form of a curved projection 32 arranged in line with the inner face 31, which favors moving the lower end 31*a* toward the inner face 11*c* of the winder 11*c*, illustrated in particular in FIGS. 5 and 6.

Preferably, the stationary finger 27 is removably fixed with respect to the contour 9*a* of the extraction opening 9 or in proximity to the latter. To achieve this, the stationary finger 27 has a lower part 33 equipped with an orifice 34 permitting screw fastening 35 with respect to the front lateral face 2*b* of the housing 2, as illustrated by FIGS. 2, 7 and 8. One could envision other removable fixing means without departing from the context of the invention. This removable fixing advantageously permits replacing the stationary finger 27 in order to better adapt it to the type of hair to be curled, or when the finger is worn, in order to limit as much as possible the friction of the curled strand during its release.

As illustrated in FIG. 2, the appliance 1 comprises a heating element 36 arranged inside the mandrel 10 in order to heat it and to heat the hair strand. Such a heating element 36 is known to those skilled in the art, so it will not be described. One could also envision other heating means arranged in the winding chamber 8, for example on the inner cage 17 in order to heat the strand in the second spacing 19 between the inner cage 17 and the winder 11.

The housing 2 of the appliance 1 is manipulated by the grip handle 3, its lateral face 2*a*, which has the extraction opening 9, being positioned against the scalp during the various curling operations. The arrangement of the grip handle 3 in line with the slot 7, facilitates manipulation of the appliance 1. However, one could anticipate variants in the arrangement of the grip handle with respect to the housing 2, without departing from the context of the invention. At the beginning of the curling operation, after the user sets the heating element 36 to a set-point temperature, the strand is positioned inside the slot 7 and then guided by the flanges 20*a*, 20*b* to the second spacing 19. Because the winder 11 and the mandrel 10 are inclined with respect to the grip handle 3, the insertion of the strand in the notch 14 is done naturally, without need to incline the strand with respect to the housing 2 and the slot 7 in order to insert it appropriately into the notch 14. The rotation of the winder 11 is then triggered by one of the control buttons 5 or 6, which permits one of the hooks 16*a*, 16*b*—depending on the direction of rotation—to grasp or catch the strand in proximity to the scalp. The configuration of the winder 11 with its surface of revolution arranged around the mandrel and its notch 14,
advantageously permits concomitantly winding the hair strand around the mandrel 10 in the inner chamber defined by the first spacing 12, and around the surface of revolution of the winder 11 in the outer chamber defined by the second spacing 19. During this concomitant winding on the winder 11 and the mandrel 10, the strand slips to the bottom 24 of the walls 22*a*, 22*b* of the slot 7. Once the end of the strand has slipped to the bottom 24 and is wound around the winder 11, the winder continues to turn, which permits continuing to wind the strand around the mandrel 10 until the entire strand is wound around the mandrel 10. The winder 11 then stops turning, the heating element 36 then remaining activated while keeping the strand wound around the mandrel 10 for a few seconds. Then the appliance 1 is moved away from the scalp, the curled strand is then displaced along the mandrel 10 toward the stationary finger 27 which, when the appliance is moved away from the head, will accompany the curl toward the extraction opening 9 in order to appropriately release the curled strand.

Embodiment variants of the guide means may be envisioned in the context of the invention. In particular, one could anticipate embodiment variants of the slot 7 with only the walls 22*a*, 22*b* in a V shape, without any cross rib 25, 26, or conversely, one could anticipate cross ribs 25, 26 on walls parallel to each other, where the shape of the cross ribs, in the form of a triangle or a portion of a disk, defines by itself a flared shape or a V shape. One could also anticipate waves 37, 38 arranged on the length of the two walls 22*a*, 22*b* between the cross ribs 25, 26, as illustrated in FIGS. 1 and 2, which also help to reduce friction of the hair strand on the two walls 22*a*, 22*b*. One could also anticipate these waves 37, 38 on the two walls 22*a*, 22*b* forming a V, without the presence of the cross ribs 25, 26.

Figure 10:
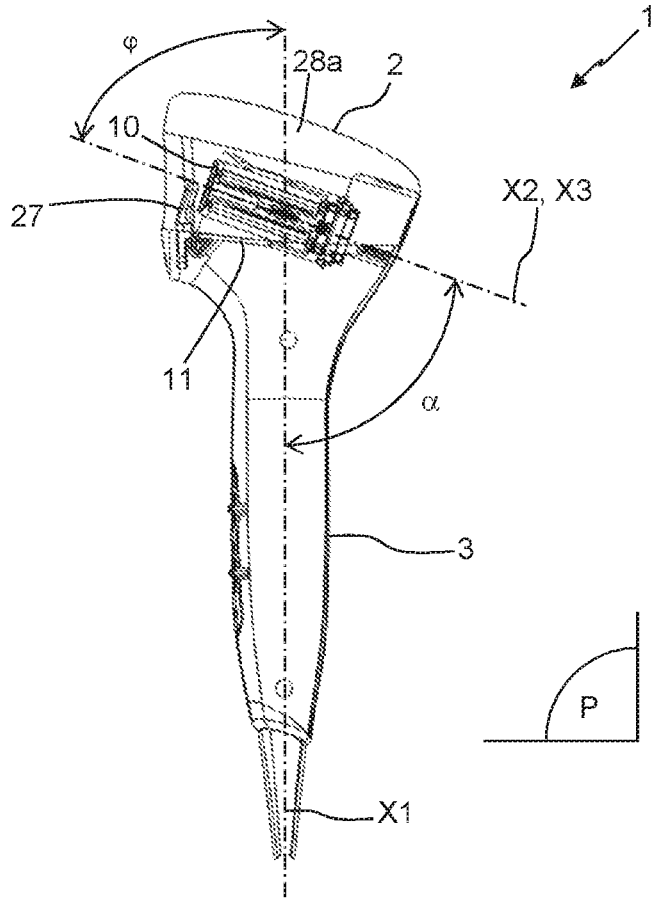
FIG. 10 illustrates a three-dimensional view of a second embodiment of the hair styling appliance according to the invention.
Figure 11:
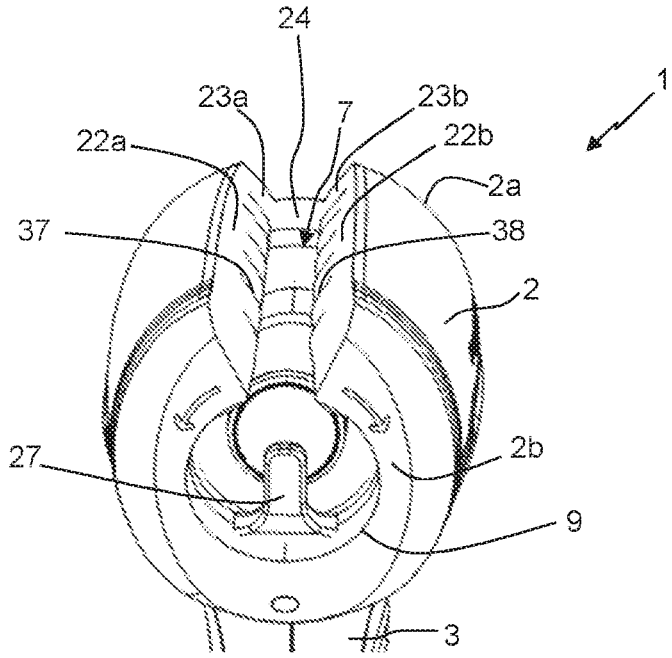
FIG. 11 illustrates the part of the hair curling appliance corresponding to the housing, according to this second embodiment, showing the design of the slot.

On the embodiment variant of the appliance 1, illustrated in FIGS. 10 and 11, the slot 7 has two walls 22*a*, 22*b*, which are inclined together in a V shape and have waves 37, 38 as described previously for the embodiment variant in FIGS. 1 to 9. Likewise, in FIG. 11 we see the parts 23*a*, 23*b* of the two walls 22*a*, 22*b* which consist of a single
piece with a common bottom 24, as described for the preceding variant, with a slight difference since the bottom 24 is not rounded but flat, as observed in FIG. 11.

Figure 12:
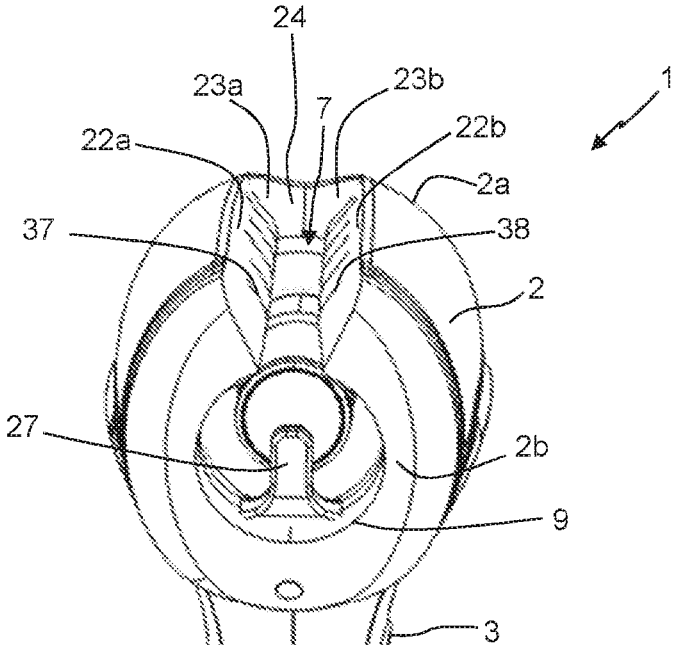
FIG. 12 illustrates a variant of the slot on the appliance illustrated in FIGS. 10 and 11.

In another embodiment variant of the appliance 1, illustrated in FIG. 12, the slot 7 has two walls 22*a*, 22*b*, which are inclined together in a V and have waves 37, 38 as described previously. In addition, the parts 23*a*, 23*b* of the two walls 22*a*, 22*b* consist of a single piece with a common bottom 24 which is curved or in the shape of a spoon, as seen in this FIG. 11, this form also making it possible to guide the hair strand in the slot 7 during its winding around the winder 11 and the mandrel 10.

According to the two aforementioned embodiment variants of the appliance 1, the design variants of the winder 11 and of the stationary finger 27, as described previously, also apply.

One could also anticipate variants of the stationary finger 27.

Other embodiment variants of the appliance 1 may also be considered without departing from the context of the invention. In the mode of embodiment of FIGS. 1 to 4, the second axis X2, according to which the circular form of the housing 2 is defined, is perpendicular to the first axis X1, that is, inclined by an angle φ equal to 90° with respect to the second axis X2. In the embodiment variant illustrated in FIGS. 10 and 11, the second axis X2 coincides with the third axis X3 of the mandrel 10 and of the winder 11, that is, the second axis X2 is inclined by an angle φ with respect to the first axis X1 corresponds to the angle of inclination α of the third axis X3 with respect to the second axis X2 [sic]. One could also anticipate a second axis X2 parallel to the third axis X3, but which does not coincide with the latter. One could also anticipate an angle of inclination φ of the second axis X2 with respect to the first axis X1 which is between the angle of inclination α of the third axis X3 and 90°, that is, $\alpha<\varphi<90°$. Thus, in the value range of the angle α of between 50° and 80°, as defined previously: when the angle α is equal to 50°, the angle φ may be between 50° and 90°; when the angle α is equal to 80°, the angle φ may be between 80° and 90°; and for the preferred value of the angle α equal to 70°, the angle φ may be between 70° and 90°. One could also, in other variants, anticipate an angle of inclination α between the first axis X1 and the third axis X3 which is equal to 90°, that is, the two axes X1 and X3 are perpendicular to each other, without departing from the essential context of the invention, with a winder 11 having a cylindrical or conical surface of revolution.

The invention claimed is:

1. A hair styling appliance for curling a strand of hair comprising: a handle;

a housing extending perpendicular to the handle and which comprises a winding chamber having a shape of a revolution along a first axis, an insertion slot which extends along a full length of the housing in a direction of the first axis and which leads to the winding chamber, and an extraction opening arranged in a lateral end of the housing to which the winding chamber leads, a heated mandrel which has one end fixed to an opposite lateral end of the housing and a free end arranged close to the extraction opening, and which extends in the winding chamber along an second axis, different from the first axis and at an acute angle to the first axis, the second axis, defined in a plane passing through the first axis and through the insertion slot, a winder arranged in the winding chamber and rotatably mounted in at least one direction along the second axis, the winder being configured to wind the strand inserted in the insertion slot around the mandrel, during its rotation, and a stationary finger arranged on a contour of the extraction opening and obstructing the extraction opening, the stationary finger extending perpendicular to the second axis, a shape of the stationary finger and a location of the stationary finger with respect to the free end of the mandrel cooperate to prevent the rotation of the strand around the mandrel without risk of bypassing the stationary finger during the rotation of the winder, and to help release the curled strand along the mandrel and wherein the stationary finger does not contact the mandrel.

2. The hair styling appliance according to claim 1, wherein the stationary finger is parallel to the plane, and has at least one lateral locking face configured so that a straight line, which passes through a base of the at least one lateral locking face and perpendicularly cuts the second axis, forms with the at least one lateral locking face an angle of between 0 and 35 degrees.

3. The hair styling appliance according to claim 2, wherein the winder turns in both a clockwise and a counterclockwise direction around the mandrel, the stationary finger having two lateral locking faces arranged symmetrically with respect to the plane.

4. The hair styling appliance according to claim 2, wherein the angle formed with the at least one lateral locking face is 25 degrees.

5. The hair styling appliance according to claim 1, wherein the stationary finger is parallel to the plane, said stationary finger being configured to extend radially inward relative to a peripheral contour of the mandrel in the direction of the other axis, at a height of between 6 mm and 18 mm.

6. The hair styling appliance according to claim 5, wherein the height is 12 mm.

7. The hair styling appliance according to claim 1, wherein the stationary finger is parallel to the plane, the stationary finger being spaced apart from the free end of the mandrel by a distance of between 1 mm and 5 mm.

8. The hair styling appliance according to claim 7, wherein the distance is 3 mm.

9. The hair styling appliance according to claim 1, wherein the stationary finger has an inner face arranged facing the free end of the mandrel, the inner face having a curved shape configured to support the release of the strand of curled hair through the extraction opening.

10. The hair styling appliance according to claim 9, wherein the inner face has an end which extends in the form of a protrusion.

11. The hair styling appliance according to claim 1, further comprising removable fixing means arranged between the stationary finger and the contour of the extraction opening.

12. The hair styling appliance according to claim 1, wherein the winder is hollow and has a surface of revolution along the second axis, and is arranged with a first spacing around the mandrel in the winding chamber, coaxial with the mandrel along the second axis, the winder having on its surface of revolution catching means which are configured to catch the strand in the winder's initial position, and then to rotate the strand during the rotation of the winder, the winder being rotatably mounted along the second axis and configured to successively grasp the proximal end of the strand, concomitantly wind the strand around the mandrel and the winder, and then completely wind the strand around the mandrel, during its rotation in at least one direction.

13. The hair styling appliance according to claim 12, wherein the winder has a free edge arranged on the side of the free end of the mandrel, and wherein the catching means comprises a notch which extends on the surface of revolution of the winder and leads to the free edge, the notch being configured to allow the strand to penetrate the first spacing between the mandrel and the winder, in an initial position of the winder.

14. The hair styling appliance according to claim 13, further comprising gripping means formed on at least one of two ends of the notch, intersecting with the free edge.

15. The hair styling appliance according to claim 14, wherein the gripping means are formed on both ends of the notch.

16. The hair styling appliance according to claim 12, wherein the winder has a conical shape along the second axis, the conical shape presenting an expansion in the direction of the free end of the mandrel.

17. The hair styling appliance according to claim 1, wherein the insertion slot has two walls which extend longitudinally in the direction of the first axis and which form between them a V configured to help the strand penetrate the winding chamber.

18. The hair styling appliance according to claim 1, further comprising heating means configured to heat the strand of hair inside the winding chamber.

19. The hair styling appliance according to claim 18, wherein the heating means are arranged in the mandrel.

* * * * *